US006003916A

United States Patent [19]

Chalmers

[11] Patent Number: 6,003,916

[45] Date of Patent: Dec. 21, 1999

[54] SNOW-REMOVAL DEVICE

[76] Inventor: Stephen B. Chalmers, 8040 S. Honore, Chicago, Ill. 60620

[21] Appl. No.: 09/221,768

[22] Filed: Dec. 28, 1998

[51] Int. Cl.[6] ..... E01H 5/10

[52] U.S. Cl. ..... 294/54.5; 37/227; 37/230

[58] Field of Search ..... 294/49, 51, 54.5, 294/59; 37/200, 227–230; 15/236.01, 236.02; 30/140

[56] References Cited

U.S. PATENT DOCUMENTS

| | | | |
|---|---|---|---|
| 1,278,621 | 9/1918 | Field | 294/54.5 |
| 1,298,200 | 3/1919 | Gorgey | 37/230 |
| 1,340,263 | 5/1920 | Berry | 37/200 |
| 1,526,903 | 2/1925 | Connolly | 37/227 |
| 2,599,098 | 6/1952 | Flynn | 37/227 |
| 2,699,614 | 1/1955 | Welch | 37/230 |
| 2,996,111 | 8/1961 | Mocerino et al. | 294/54.5 |
| 3,935,425 | 1/1976 | Weissberger et al. | 15/236.02 |
| 4,034,489 | 7/1977 | Hughes, Jr. | 37/230 |
| 4,139,760 | 2/1979 | Banks | 30/140 |
| 5,357,646 | 10/1994 | Kim | 15/236.02 |
| 5,419,600 | 5/1995 | Tisbo et al. | 294/54.5 |

FOREIGN PATENT DOCUMENTS 58844 7/1941 Denmark .

*Primary Examiner*—Dean J. Kramer
*Attorney, Agent, or Firm*—Joan I. Norek; The Law Office of Joan I. Norek

[57] ABSTRACT

A snow-removal, such as a snow shovel, snow plow and the like, includes a heated blade. The snow-removal device might also provide a selection of temperature settings for the heated blade. The snow-removal device at least fluidizes the snow when the blade slices into it, whereby the fluidized snow lubricates the interface region between the blade and the snow, diminishing the physical effort required.

16 Claims, 3 Drawing Sheets

SNOW-REMOVAL DEVICE

BACKGROUND OF THE INVENTION

A conventional snow shovel is a hand implement or tool used to manually transfer snow from one spot or location to another. When clearing a sidewalk of snow, for instance, the common use of a snow shovel entails a repetitious scooping up of snow from the sidewalk area. Then each shovel-full of snow must be deposited or discarded at an adjacent or at least nearby location, such as a bordering lawn area. This commonplace task is far from effortless. Snow has a relatively high density, even when loosely packed. Compacted snow and "wet" snow (snow that contains a fraction of liquid water) has an even higher density. The density of snow varies from about 0.05 $d_w$ to about 0.25 $d_w$, wherein "$d_w$" is the density of room temperature liquid water.

The normal toilsome shoveling action of slicing into a snow pile, lifting from under a significant shovel-full of snow, and then transporting that snow balanced on the shovel blade in an elevated position to the point at which it is heaved to the side, is a significant manual effort. It is a significant manual effort that is repeated many times in the clearing of even a small area. The benefits of a even a minor physical relief during each shoveling action multiplies into a considerable degree of relief over the course of the snow cleanup.

A conventional snow plow is a power implement or machine used for the bulk transfer snow from one spot or location to another. When clearing a sidewalk of snow for instance, the common use of a snow plow entails a repetitious pushing, and/or sidling, sections of the snow to an adjacent or at least nearby location, such as a bordering lawn area. This commonplace task is requires less manual exertion than shoveling, but nonetheless is also far from effortless and is a strain on the snowplow itself. The benefits of a even a minor physical relief (corporal and/or mechanical) during the plowing action also multiplies into a considerable degree of relief over the course of the snow cleanup.

BRIEF SUMMARY OF THE INVENTION

The snow-removal device of the present invention is a snow-removal instrumentation or device, such as a snow shovel, snow plow and the like, that includes a heated blade. The snow-removal device preferably provides a selection of temperature settings for the heated blade. The snow-removal device at least fluidizes the snow when the blade slices into it, whereby the fluidized snow lubricates the interface region between the blade and the snow, diminishing the physical effort required.

DETAILED DESCRIPTION OF THE INVENTION

Figure 1:
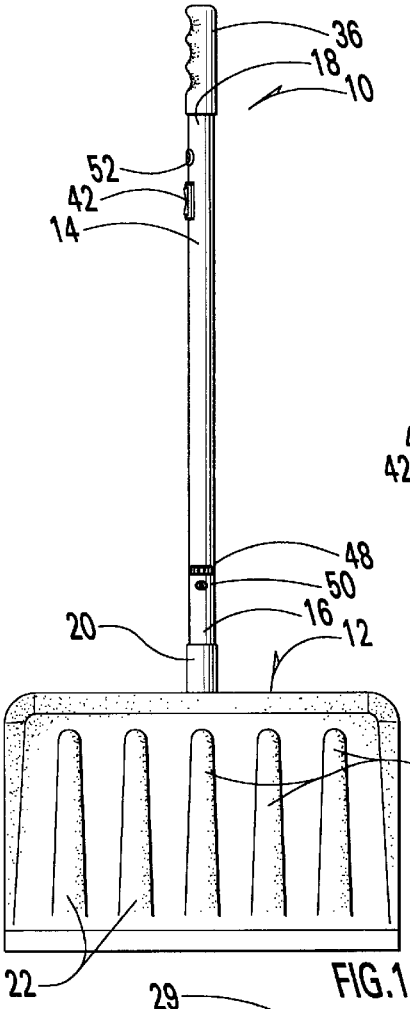
FIG. 1 is a partially diagrammatic elevated front view of a snow shovel of the invention.
Figure 2:
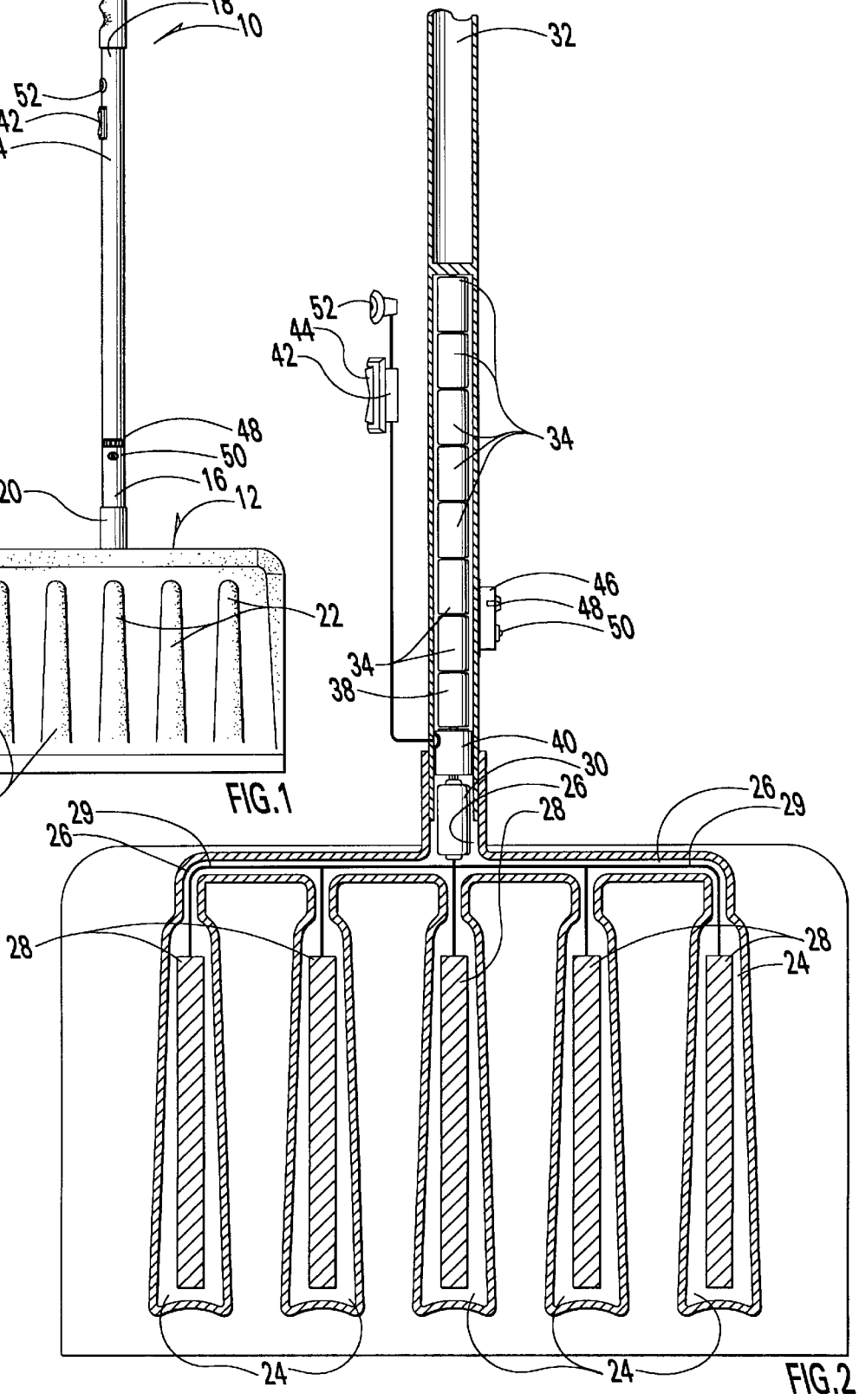
FIG. 2 is a diagram of the internal components of the snow shovel of FIG. 1.
Figure 3:
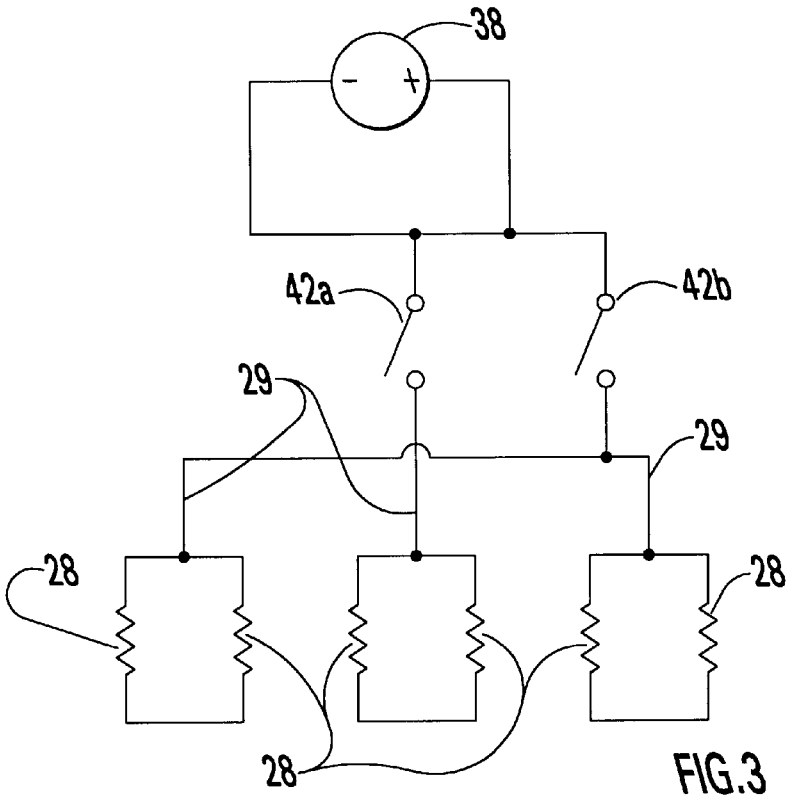
FIG. 3 is a circuit diagram of the snow shovel of FIG. 1.

Referring to FIGS. 1 to 3 there is shown a snow-removal device of the present invention, a manual snow shovel 10, having a blade 12 and an elongate, tubular handle 14 of conventional configuration and size. The blade 12 is mounted on the distal end 16 of the handle 14 opposite the proximal end 18 that is gripped or otherwise held or grasped by the user. The blade 12 as shown is a unitary member having an upper center flange or collar 20 and a plurality of substantially parallel, vertical raised furrows, ridges or ribs. 22 The blade 12 is mounted by its collar 20 to the handle's distal end 16 via conventional mechanisms (not shown) such as being fitted over and clamped or snapped into place. A conventional rubber-like hand grip 36 is provided at the handle's proximal end 18.

The ribs 22 of the shovel's blade 12 comprise or define hollow ducts or conduits 24. These conduits 24 are each open at their upper ends to a channel 26 that extends along the upper section of the blade 12 and into a hollow lower section of the collar 20. The conduits 24 each terminate or are closed at their lower ends. Contained within the ducting formed by the conduits 24, upper channel 26 and within the hollow part of the collar 20 is a heat source, namely plurality of electrical heating elements 28 (electrical heating circuits each having a high resistance, heating section or component referred to herein as a heating element) and their electrical leads 29. As shown, the heating elements are substantially housed within the conduits 24 formed by the ribs 22, with the remainder of the ducting providing a housing and protected pathway for the electrical leads 29. The heating elements 28 (six as shown) are each substantially encased within a rib 22 of the blade 12, and their electrical leads 29 run between the heating elements 28 and a center electrical box or receptacle 30.

The shovel handle 14 holds a power source. As shown, the handle 14 is formed with an elongate chamber or battery compartment 32 which holds a plurality of batteries 34. The batteries 34 are loaded at the top, proximal end 18, an end rubber-type grip 36 screwing off to expose the compartment 32. The batteries 34 are disposed in end-to-end alignment in electrical connection with each other and, through the physical contact of the terminal or distal battery 38, are in electrical connection to a primary electrical fitting 40 that in turn is in selective electrical communication the electrical leads 29 within the center receptacle 30. The power source, namely the batteries 34, powers the heating elements 28. A switch 42 is mounted with its actuator 44 exposed on the side of shovel handle 14. The switch 42 provides a series of settings such as an "off" setting (switch members 42*a* and 42*b* both open) and three "on" settings, respectively "low" (switch member 42*a* closed and switch member 42*b* open), "medium" (switch member 42*a* open and switch member 42*b* closed) and "high" (switch member 42*a* and 42*b* both closed). In the off mode, there is no electrical connection between any of the heating elements 28 and the power source. In the low, medium and high modes there is electrical connection between the power source and respectively two, four and six of the heating elements 28 by way of the switch 42, which mates the selected heating element circuities to the primary electrical fitting 40 bringing them into electrical communication with the batteries 34 in a conventional manner. This is best seen in the simple diagrammatic circuit diagram of FIG. 3.

The suitable battery compartment, such as the battery compartment 32 of the embodiment of FIGS. 1 to 3, can be formed from about 35 to about 40 inches in length, and it thus would have a holding capacity for about 14 to 16 size D batteries (which are each about 2.43 inches long and for lithium batteries rated as high as about 3.5 nominal volts). The batteries 34 are preferred rechargeable batteries of the nickel cadmium or lithium type. The shovel handle 14 includes an internally mounted, conventional battery charger, with external prongs 48 that can be folded flush with the outer surface of the shovel handle 14 when not in use. Embedded in the wall of the tubular shovel handle 14 is battery-charging signal light 50 in electrical communication with the battery charger 46. The battery-charging signal light 50 blinks on-and-off when the batteries 34 are fully charged.

The heating element components of the present invention can be of any suitable conventional type, for instance strip heaters, tubular heaters, cartridge heaters, ceramic heaters, fiberglass-sheath flexible "rope" heaters, foil heaters, and the like, or even quartz heaters. Such type of heating elements are available commercially from many sources, including without limitation from Trent, Inc. of Philadelphia, Pa., from Enercon Systems Inc. of Elyhia, Ohio, from Applied Test Systems, Inc. of Butler, Pa., Watlow, of St. Louis, Mo., and from others.

The temperature reached at any point along the surfaces of a snow removal blade of the present invention is determined by a variety of factors, including without limitation the voltage supplied by the power source, the heat source or heating element type, the number of heating elements used per unit surface area of the shovel blade, the material and thickness of the blade, the external ambient temperature, the extent of contact with snow during use, and the like. At moderate blade temperatures above water's freezing point there should be at least be some fluidization of snow to the liquid state at or about the blade/snow interface during use. At high blade temperatures there may be fluidization of snow to the gaseous state at the blade/snow interface during use.

The power source need not be an internal power source such as the alignment of batteries 34. Also shown for the embodiment of FIGS. 1 to 3 is an optional AC circuit adaptor 52 for use in the optional powering the heating elements via a heavy-duty extension cord run from a standard home 110 V electrical outlet. Such an external power source might advantageously be combined with heating elements capable of heating the shovel blade 12 to higher temperatures.

Figure 4:
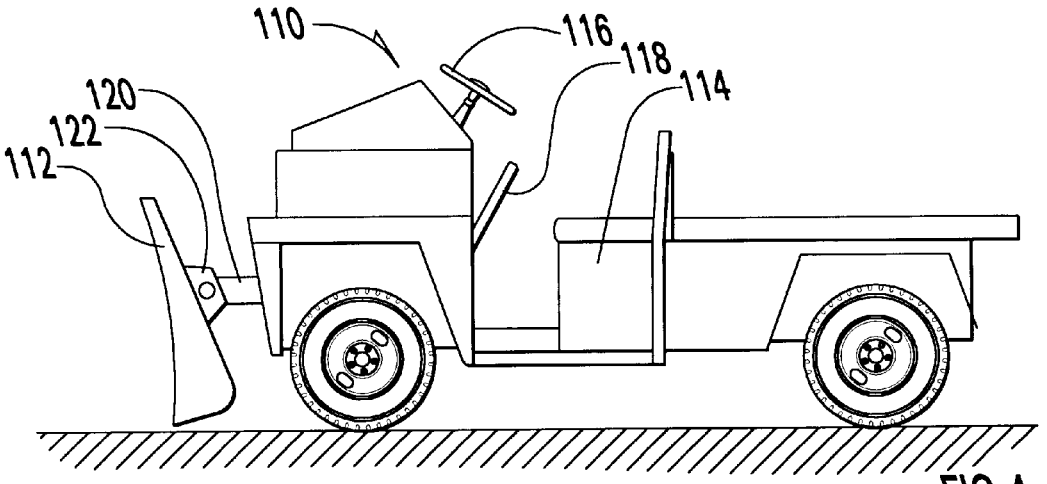
FIG. 4 is a partially diagrammatic elevated side view of a snow plow of the invention.
Figure 5:
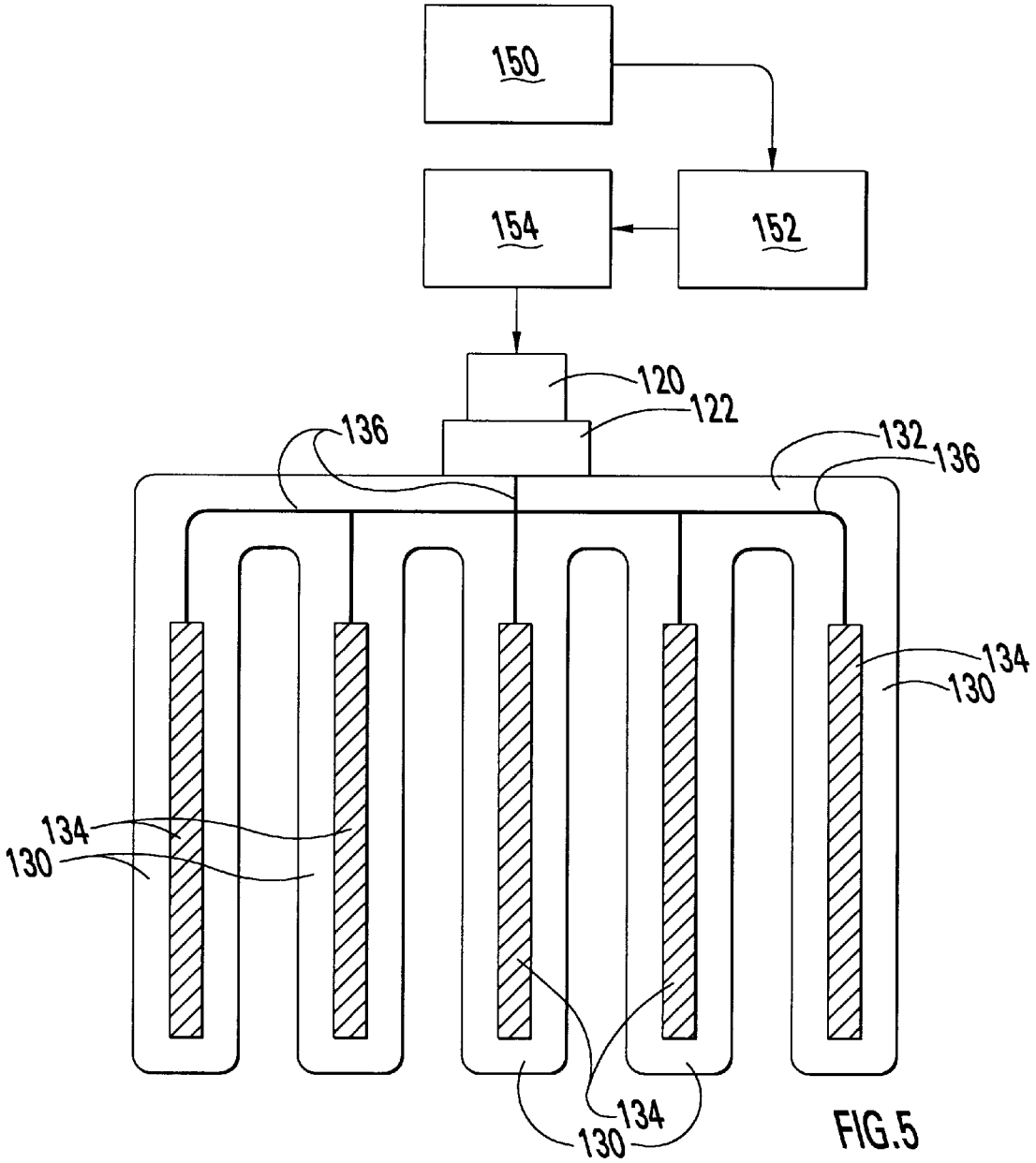
FIG. 5 is partial diagram and partial flow-diagram of some of the internal and external components of the snow plow of FIG. 4.

Referring now to FIGS. 4 and 5, there is shown a snow-removal device of the present invention, namely a snow plow 110 having a front-mounted blade 112, body core 114, a conventional steering wheel 116 and a blade-control handle of conventional configuration and size 118. The plow 110 has a conventional coupling 120 that functionally interconnects the blade 112 to the core body core 114, which is referred to herein as the primary coupling 120. The coupling 120 is affixed to the core body core 114 and attaches to the blade 112 at a connection member 122. The blade 112 has a plurality of substantially parallel, vertical ribs (not shown) that are the encasements of the hollow ducts or conduits 130. These conduits 130 are each in communication with a channel 132 that transverses the blade 112 and opens to an electrical fitting (not shown) carried in the connection member 120. The conduits 130 are each otherwise closed. Contained within the ducting formed by the conduits 130 and the channel 132 is a heat source, namely plurality of electrical heating elements 134, together with their electrical leads or circuitry 136. The heating elements 134 are contained within the conduits 130 of the ribs and their electrical leads 136 run from and to the electrical fitting within the connection member 120.

The body core 114 of the power snow plow 110 holds a conventional automotive-type power source. As shown, this power source also powers the heating elements 134. The power source as shown includes a gasoline-fueled engine 150, a generator 152 and a transformer 154. The engine 150 drives the snow plow 110 in conventional manner, the generator 152 converts some of the energy generated by the engine 150 into electrical energy in conventional manner, and the transformer 154 regulates the transmission of electrical power from the generator 152 to the heating circuit. A switch (not shown) controls the transmission of electrical energy to the heating elements 134 by opening and closing the electrical path therebetween. The switch has a normally-off lever-arm actuator 160, which when depressed opens the electrical communication, permitting electrical power to be transmitted to the heating elements at a level that depends on the degree of pressure applied, in a conventional manner. The electrical power is transmitted to electrical circuitry terminals of the heating circuits held within the electrical fitting carried on the connection member 122. The potential electrical communication between the heat source 134 and power source system 150, 152, 154 is provided by the mating of components when the blade 112 is joined to the body core 114 of the plow 110 by conventional mechanisms. The electrical communication is of course breached when the switch is in its normally-off position. An alternative embodiment, not illustrated, is the powering of the heating circuits by a single or plurality of large batteries carried within the body core 114 or mounted externally thereof, wherein the generator 152 is employed for recharging of batteries while the plow 110 is being operated.

To diminish electric shock risks in any embodiment, the heating element circuits should have a sufficient degree of flexibility (so that they normally follow the flex of the shovel blade during use without undue strain or stress), be sufficiently electrically insulated from the body of the shovel or plow blade, and grounded to the extent possible.

The blade and other components of a snow-removal device of the present invention can be formed from conventional materials, such as a light weight metal for the blade and wood or a heavy-duty plastic for the handle. A high-end-cost shovel might be composed at least in part of a composite material, such as a resin and carbon fiber composite. The ribs encasing the heating elements alone will stiffen the blade of a shovel or plow or the like in the manner of conventional ridges. Additional stiffening ribs or ridges of course can be interposed between the ribs encasing the heating elements. The blade should be formed of a material having heat conduction properties sufficient for the purposes of the present invention, that is, to fluidize snow at the snow/blade interface. In preferred embodiment, the blade should be formed of a material having sufficient heat retention properties so that the powering of the heat source might be done only intermittently during the snow removal process. In other words, if a blade maintains a sufficient temperature for a time period after the power to the heat source is cut off, the shoveling can be continued for a while with the shovel in the off mode. A normally-off switch means, such as the switch mentioned in the above description of the snow plow of FIGS. 4 and 5, is particularly suited to the operation of the snow-removal device while powering the heating elements of the blade only intermittently.

The present invention is not limited to the embodiments or combinations or subcombinations described above, and these embodiments and the terminology used to describe same are for illustration and not limitation purposes.

The present invention broadly is a snow-removal device having an internally heated blade. The snow removal device preferably comprises a blade, a means for blade manipulation and at least one heat source housed within the blade. The heat source preferably is at least one electrical heating element, and the snow-removal device further includes a power source that powers the heating element at least intermittently. The heating element preferably heats the blade to a snow-fluidizing temperature.

The present invention is preferably a snow shovel having a heat-source containing blade, an elongate, tubular handle having a distal end and a proximal end, a hand grip mounted on the proximal end of the handle, and a power source that powers the heat source. The heat source is preferably at least one electrical heating element. The blade is normally mounted on the distal end of the handle via a collar. In preferred embodiment, the ribs of the blade are hollow conduits each open at a first end to a channel that extends along the upper section of the blade and into the collar. The conduits each are otherwise closed. The snow shovel preferably has a plurality of electrical heating elements and a heating element circuitry, the heating elements being housed within the conduits of the ribs of the blade, and the circuitry leading from and to an electrical box or receptacle. Preferably the power source is housed within the shovel's handle. Alternatively or optionally the power source is an AC circuit adaptor for use in powering the heating elements from a standard 110 V electrical outlet. The shovel might further include a switch having an actuator mounted on the handle in an orientation that places the actuator at an exposed position along the length of the handle. The handle can be formed with an elongate battery compartment configured to hold a plurality of batteries, and wherein the grip is a detachable grip that normally encloses a compartment outlet configured for the passage of batteries into and out of the compartment. Preferably the compartment holds a plurality of batteries disposed in end-to-end alignment in electrical connection, and the batteries are in electrical connection to a primary electrical fitting. The shovel preferably further has a battery charger and a battery-charging signal light.

The snow-removal device could also be a snow plow comprised of an internally heated blade, a body core, optionally a steering wheel, and a blade-control mechanism. The blade is formed preferably with a plurality of ribs, preferably substantially parallel, vertical ribs, forming a conduit system housing a plurality of heating elements. The core body preferably holds an power source comprising an engine, generator and transformer.

I claim:

1. A snow shovel comprising:

a blade;

a means for blade manipulation comprising an elongate, tubular handle having a distal end and a proximal end;

a hand grip mounted on said proximal end of said handle;

wherein said blade has an upper center collar and a plurality of substantially parallel vertical raised ribs, wherein said blade is mounted by said collar to said distal end of said handle, wherein said ribs of said blade are hollow conduits each open at their upper ends to a channel that extends along an upper section of said blade and into said collar, wherein said conduits each are closed at their lower ends; a heat source housed within said blade comprising a plurality of electrical heating elements and heating element circuitry, said heating elements being housed within said conduits of said ribs of said blade, and said circuitry leading from and to a center electrical box or receptacle; and a power source that powers said heat source, wherein said blade is heated by said heat source.

2. The snow shovel of claim 1 further including a means providing a selection of temperature settings for said blade.

3. The snow shovel of claim 1 wherein said heating elements heat said blade to a snow-fluidizing temperature.

4. The snow shovel of claim 1 wherein said power source is housed within said handle.

5. The snow shovel of claim 1 further including an AC circuit adaptor for use in powering said heating elements from a standard 110 V electrical outlet.

6. The snow shovel of claim 1 further including a switch having an actuator mounted on said handle in an orientation that places said actuator at an exposed position along the length of said handle.

7. The snow shovel of claim 6 wherein said switch provides a series of settings including an "off" setting and three "on" settings, said "on" settings comprising a "low" setting, a "medium" setting and a "high" setting.

8. The snow shovel of claim 1 wherein said handle is formed with an elongate battery compartment configured to hold a plurality of batteries, and wherein said grip is a detachable grip that normally encloses a compartment outlet configured for the passage of batteries into and out of said compartment.

9. The snow shovel of claim 8 wherein said compartment holds said power source comprising a plurality of batteries disposed in end-to-end alignment in electrical connection, and said batteries are in electrical connection to a primary electrical fitting.

10. The snow shovel of claim 8 further comprising a battery charger and a battery-charging signal light.

11. A snow shovel comprising:

a blade traversed by ribs defining conduits;

an elongate, tubular handle having a distal end and a proximal end;

a hand grip mounted on said proximal end of said handle;

a heat source comprising a plurality of electrical heating elements and heating element circuitry;

a power source that powers said heating element;

wherein said blade is mounted on said distal end of said handle opposite said proximal end, wherein said blade has an upper center collar, wherein said blade is mounted by said collar to said distal end of said handle, and wherein said heating elements are housed within said conduits and said circuitry leads from and to an electrical box or receptacle.

12. The snow shovel of claim 11 wherein said power source is housed within said handle.

13. The shovel of claim 12 further including an AC circuit adaptor for use in powering said heating elements from a standard 110 V electrical outlet.

14. A snow plow comprising:

a front-mounted blade formed with a plurality of substantially parallel, vertical ribs forming a conduit system housing a heat source, said heat source comprising plurality of heating elements;

wherein said blade is heated by said heat source;

a body core holding a power source, said power source comprising an engine, generator and transformer;

a means for blade manipulation comprising a blade-control mechanism; and a means for steering.

15. The snow plow of claim 14 further including a means providing a selection of temperature settings for said blade.

16. The snow plow of claim 14 wherein said heating elements heat said blade to a snow-fluidizing temperature.

* * * * *